US006551705B1

(12) United States Patent
Ohnishi et al.

(10) Patent No.: US 6,551,705 B1
(45) **Date of Patent: *Apr. 22, 2003**

(54) CHITOSAN-CONTAINING ACRYLIC FIBERS AND PROCESS FOR PREPARING THE SAME

(75) Inventors: Hiroaki Ohnishi; Yoshihiro Nishihara; Hiroshi Hosokawa; Seizo Oishi; Masako Iwamoto; Yasuyuki Fujii; Hajime Itoh, all of Otake; Naoto Ohsuga, Nagoya, all of (JP); Gary J. Capone, Decatur; Charles W. Emerson, Hartselle, both of AL (US)

(73) Assignee: Mitsubishi Rayon Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 156 days.

(21) Appl. No.: 09/271,272

(22) Filed: Mar. 17, 1999

Related U.S. Application Data

(63) Continuation of application No. PCT/JP97/02725, filed on Aug. 6, 1997, now abandoned.

(30) Foreign Application Priority Data

| | | |
|---|---|---|
| Sep. 17, 1996 | (JP) | 8-245136 |
| Sep. 17, 1996 | (JP) | 8-245137 |
| Nov. 11, 1996 | (JP) | 8-299099 |
| Jul. 4, 1997 | (JP) | 9-179863 |

(51) Int. Cl.[7] ..... N01F 6/00
(52) U.S. Cl. ..... 428/372; 428/364
(58) Field of Search ..... 428/364, 372

(56) References Cited

U.S. PATENT DOCUMENTS

| | | | | |
|---|---|---|---|---|
| 4,861,659 A | * | 8/1989 | Takada et al. | 428/364 |
| 5,320,903 A | | 6/1994 | Hirukawa et al. | 428/364 |
| RE35,151 E | | 1/1996 | Hirukawa et al. | 428/364 |
| 5,643,971 A | * | 7/1997 | Roenigk | 523/122 |
| 5,756,111 A | * | 5/1998 | Yoshikawa et al. | 604/289 |
| 6,143,835 A | | 11/2000 | Capone et al. | 525/329.1 |
| 6,197,322 B1 | | 3/2001 | Dutkiewicz et al. | 424/412 |

FOREIGN PATENT DOCUMENTS

| | | |
|---|---|---|
| JP | 58-191224 | 11/1983 |
| JP | 2-307915 | 12/1990 |
| JP | 4-257301 A | 9/1992 |
| JP | 8-260354 A | 10/1996 |
| JP | 9-217269 A | 8/1997 |

OTHER PUBLICATIONS

Abstract of JP 4–82965, Mar. 16, 1992.
Abstract of JP 8–120525, May 14, 1996.
Abstract of JP 7–68648, Jul. 26, 1995.
Abstract of JP 8–26–354, Oct. 8, 1996.

* cited by examiner

*Primary Examiner*—Newton Edwards
(74) *Attorney, Agent, or Firm*—Fitch, Even, Tabin & Flannery

(57) ABSTRACT

The present invention is directed to chitosan-containing acrylic fibers having a total chitosan content of 0.05 to 2% by weight and an extractable chitosan content of not less than 0.03% by weight to less than the total chitosan content. The antimicrobial activity of the chitosan-containing acrylic fibers of the present invention can persist for a long period of time and is not deteriorated even when subjected to posttreatments, such as dyeing and bleaching of fibers, and treatments in usual service environments of fiber products, such as washing and ironing.

20 Claims, No Drawings

CHITOSAN-CONTAINING ACRYLIC FIBERS AND PROCESS FOR PREPARING THE SAME

RELATED APPLICATIONS

This is a continuation of International Appln. No. PCT/JP97/02725 filed Aug. 6, 1997 which designated the U.S., now abandoned.

TECHNICAL FIELD

The present invention relates to antimicrobial acrylic fibers which can be used as clothes, fancy goods, interior decorations and materials without exerting a bad influence on the human body and environment, and a process for preparing the same.

BACKGROUND ART

Recently, antimicrobial fibers have widely been used as clothes and fiber products for infant and old people for the purpose of inhibiting the growth of various bacteria, thereby to prevent the occurrence of unpleasant odor. Now, the antimicrobial fibers are widely distributed in a market as a product for general consumers in response to consumers' strong requirements for health and comfort.

In these antimicrobial fibers, various antimicrobial agents are used and a process of incorporating the antimicrobial agents in the fiber products varies with purposes. As the antimicrobial agent, for example, there have been known those disclosed in a technique using an inorganic metal substance including a silver-zeolite system (Japanese Patent Kokai Publication No. 5-272008, etc.), a process of adding fine powders of copper compound or metals such as copper and zinc (Japanese Patent Kokai Publication No. 115440/80, etc.), a process using a derivative of a quaternary ammonium salt (Japanese Patent Kokai Publication No. 130371/84), a process using a halodiallyl urea compound such as trichlorocarbanilide (Japanese Patent Kokai Publication No. 259169/90), and processes using other compounds such as thiabendazole type compound (Japanese Patent Kokai Publication No. 616/86), phenol type compound (Japanese Patent Kokai Publication No. 252713/85, etc.) and fatty acid ester compound (Japanese Patent Kokai Publication No. 6173/88, etc).

However, there is a problem that, when fibers obtained by incorporating silver or copper compounds are subjected to a bleaching treatment, the antimicrobial activity is lost by degradation of silver and copper compounds. In case of some fiber obtained by incorporating an organic compound, there is also a problem that the antimicrobial agent is eliminated by posttreatments, such as dyeing and softening, and washing, thereby to lose the antimicrobial activity and the possible formation of injurious material can not be denied under conditions of usual service environments including posttreatments and discarding.

Under these circumstances, an agent for imparting functional characteristics of a natural antimicrobial agent has attracted special interest recently. For example, it has been considered that hinokitiol extracted from Aomori hiba and Taiwan hinoki has functions such as antimicrobial, antifungal and mothproofing properties, whereas, chitosan as a deacetylated substance of natural polysaccharides chitin obtained from Crustacea has various functions such as antimicrobial/deodorizing, effect for inhibiting the growth of MRSA, high moistureproofness, and prevention and improvement of atopic dermatitis. There has been known a case that a pleasant feeling can be obtained when these agents are used in clothes by incorporating in fibers.

As a process of adhering chitosan to acrylic fibers, for example, a process using an adhesive, a process of incorporating fine powders of chitosan into a spinning stock solution and a process of treating fibers with an acidic solution of chitosan have been known. However, when chitosan is adhered to the fibers using an adhesive, the adhesive causes cohesive curing by a cohesive action of chitosan. Furthermore, when a trial of exerting a peculiar function of chitosan is made, the washing resistance is inferior because the amount of the adhesive is limited. Even if chitosan is ground into fine powders and the powders are uniformly dispersed in an acrylonitrile polymer solution, and then the solution is spun by a publicly known method, it is difficult to spin with good productivity because clogging of a spinning aperture of a spinning nozzle occurs.

Furthermore, the antimicrobial activity of the chitosan-containing acrylic fibers obtained by a process of immersing acrylic fibers in an acidic solution of chitosan and neutralizing the acrylic fibers in an alkali bath, thereby to deposit chitosan on the surface of the fibers is lost by posttreatments such as dyeing and softening, and washing.

Under these circumstances, generally judging, exertion of the antimicrobial/deodorizing function using chitosan, retention of the effect, and retention of fiber performances peculiar to the fibers, such as feeling are not satisfactory at present.

DISCLOSURE OF THE INVENTION

It is an object of the present invention to provide chitosan-containing antimicrobial acrylic fibers which are effective to various bacteria and are capable of avoiding deterioration of the antimicrobial/deodorizing activities due to various posttreatmens, such as dyeing, bleaching and softening of fibers, and treatments in usual service environments of fiber products, such as washing and ironing, and which do not produce an injurious material in the whole process from production through discarding, and a process for preparing the same.

The present invention is directed to chitosan-containing acrylic fibers having a total chitosan content of 0.05 to 2% by weight and an extractable chitosan content of not less than 0.03% by weight to less than the total chitosan content.

The present invention is also directed to chitosan-containing acrylic fibers having a total chitosan content of 0.05 to 2% by weight, wherein chitosan is dispersed in the fibers in the form of fine particles and an equivalent-circle average diameter of the fine particles in a cross section is from 1 to 100 nm.

The present invention is also directed to chitosan-containing acrylic fibers having a total chitosan content of 0.05 to 2% by weight and a quaternary ammonium salt content of more than the total chitosan content to not more than 3% by weight.

The acrylic fibers used in the present invention are obtained by spinning an acrylonitrile polymer, which is obtained by (copolymerizing acrylonitrile as a main component with an unsaturated monomer capable of polymerizing with acrylonitrile. When the content of an acrylonitrile unit in the acrylonitrile polymer is smaller than 50% by weight, not only the dyeing clarity and color developing property as a feature of the acrylic fibers are deteriorated, but also other physical properties including thermal characteristics are deteriorated. Therefore, the content of the acrylonitrile unit is normally not less than 50% by weight.

Examples of the unsaturated monomer capable of polymerizing with acrylonitrile include acrylic acid, methacrylic acid, or alkyl esters thereof, vinyl acetate, acrylamide, vinyl chloride, vinylidene chloride or the like. According to the purpose, there can be used an ionic unsaturated monomer such as sodium vinylbenzenesulfonate, sodium methallylsulfonate, sodium allylsulfonate, sodium acrylamidemethylpropanesulfonate, p-sodium sulfophenyl methallyl ether or the like.

Chitosan used in the present invention comprises basic polysaccharides obtained by heating chitin, which is obtained by removing calcium carbonate and protein from cuticle constituting exoskeleton of Crustacea such as crab and prawn, together with a concentrated alkali, thereby to perform deacetylation of chitin.

The chitosan-containing acrylic fibers of the present invention are those which contain chitosan at the surface or interior of the above acrylic fibers.

According to the first aspect of the chitosan-containing acrylic fibers of the present invention, the total chitosan content is from 0.05 to 2% by weight and the extractable chitosan content is not less than 0.03% by weight.

The total chitosan content refers to a total amount of chitosan which is present in the fibers, and to a value obtained by measuring the amount of chitosan after dissolving the chitosan-containing acrylic fibers in a solvent.

The extractable chitosan content refers to a value obtained by measuring the amount of chitosan wherein the chitosan-containing acrylic fibers can be extracted in an boiling acid. This extractable chitosan is chitosan which is gently bound because of its weak interaction with the acrylonitrile polymer. Therefore, it is considered that this extractable chitosan is present in the vicinity of the surface of the fibers, comparatively.

The present inventors assume that initial antimicrobial activity is exerted by the extractable chitosan. They also assume that, chitosan, which can not be extracted, out of the whole chitosan is superior in resistance because it is not easily eluted, and is not easily eliminated even by washing, but said chitosan transfers to the surface of the fibers with a lapse of time, thereby to exert the long-term antimicrobial activity. That is, in the present invention, chitosan is present in the state of these two kinds, thereby making it possible to simultaneously exert initial antimicrobial activity and resistance.

When the total chitosan content is smaller than 0.05% by weight, both initial antimicrobial activity and resistance are insufficient. On the other hand, when the total chitosan content exceeds 2% by weight, not only an improvement in the activity is not realized, but also a problem such as deterioration of the dyeability of the fibers or deterioration of the operatability due to elimination of chitosan in the spinning step arises. To maintain the color developing clarity as an advantage of the acrylic fibers, particularly, it is particularly preferred that the chitosan content is within a range from 0.05 to 1% by weight.

Furthermore, when the extractable chitosan content is smaller than 0.03% by weight, the initial antimicrobial activity is not sufficient, sometimes, it is preferably not less than 0.03% by weight. When the extractable chitosan content is the same as the total chitosan content, the long-term antimicrobial activity can not be exerted and, therefore, it is at least smaller than the total chitosan content. It is particularly preferred that the difference between the total chitosan content and extractable chitosan content is within a range from 0.03 to 0.8% by weight. When the difference is smaller than 0.03% by weight, the resistance is likely insufficient. On the other hand, when the difference exceeds 0.8% by weight, the amount of chitosan exposed on the surface is reduced and, therefore, the initial antimicrobial activity is liable to become insufficient.

According to the second aspect of the chitosan-containing acrylic fibers of the present invention, the total chitosan content is from 0.05 to 2% by weight and, at the same time, chitosan is dispersed in the fibers in the form of fine particles and an equivalent-circle average diameter of the fine particles in a cross section is from 1 to 100 nm.

When chitosan is dispersed in the form of coarse particles, the surface area of chitosan for exerting the antimicrobial activity to be expected is small, resulting in small effect. Furthermore, the resistance of the antimicrobial activity is deteriorated by posttreatments, such as bleaching and dyeing, and washing, but the degree of elimination depends on the size of dispersed particles of chitosan. That is, in case that large particles are present because the particles are dissolved or eliminated as a unit, the degree of elimination becomes comparatively large. Accordingly, it is preferred to be dispersed as particles as small as possible.

According to the present inventors' study, it has been found preferable that chitosan is dispersed in the form of fine particles in the fibers and an equivalent-circle average diameter of the fine particles in a cross section is from 1 to 100 nm. The description "the fibers are dispersed in the form of fine particles" means that the fine particles of chitosan are uniformly observed in the cross section when observing the cross section of the fibers, and shows that chitosan is uniformly dispersed into the interior of the fibers in the form of fine particles.

The evaluation of such a dispersed state can be obtained by dyeing the fibers with ruthenium tetraoxide, cutting the fibers into cross-sectional ultra-thin pieces having a thickness of about 80 nm and then analyzing a chitosan distribution diagram, which is obtained by using a transmission electron microscope (Model JEM-100OCX, manufactured by Nippon Denshi Co., Ltd.), using an image analyzer (Model Luzex III, manufactured by Nireko Co., Ltd.).

The above equivalent-circle average diameter is an index representing the size of dispersed fine particles, and shows a diameter of circle corresponding to the occupied area in the image of the respective dispersed fine particles. The size of the fine particles is preferably uniform. That is, variation in size of the particles means that the fine particles of chitosan are present in the state of being agglomerated and that the degree of dispersion is insufficient. Therefore, the smaller the standard deviation of the equivalent-circle average diameter becomes, the better. The measurement is performed with respect to randomly chosen 100 to 200 fine particles of chitosan. The number of fine particles to be measured is preferably not less than 100. Even if the number exceeds 200, any influence is actually exerted and data processing becomes complicated and, therefore, it is not practicable. Accordingly, the number is efficiently from 100 to 200.

When the equivalent-circle average diameter is larger than 100 nm, the object of the present invention may not be attained, sometimes. On the other hand, when the equivalent-circle average diameter is smaller than 1 nm, the particles are easily dissolved and, therefore, the resistance is liable to be deteriorated.

The standard deviation of the equivalent-circle average diameter is preferably not more than 100 nm. When the standard deviation of the equivalent-circle average diameter is larger than 100 nm, a small amount of remarkably large particles are present and, therefore, exertion and resistance of the antimicrobial activity maybe deteriorated, sometimes. On the other hand, when the standard deviation is not more than 100 nm, the particle diameter is uniform to such a degree that the object of the present invention can be substantially attained, and large particles, which inhibit the attainment of the object of the present invention, are not present.

Furthermore, the dispersed fine particles of chitosan are preferably dispersed without being agglomerated in view of the utilization of chitosan.

That is, it is preferred that an average of a shape factor SF defined by the following equation (Numerical Formula 1) of the fine particles of chitosan in cross section of fibers is from 100 to 300 and its standard deviation is not more than 150.

$$SF=ML^2\times\pi\times100/(4\times A) \quad \text{(Numerical Formula 1)}$$

(wherein ML represents a maximum length of fine particles of chitosan in a cross section of fibers, and A represents an area of fine particles of chitosan in a cross section of fibers).

This shape factor SF is an index which represents 100 in case of a perfect circle. The average of SF within a range from 100 to 300 represents that the particles are substantially dispersed in the form of a circle on the image, and are actually dispersed in the spherical form and are not in the agglomerated state. Moreover, when the deviation is not more than 150, the particles have substantially uniform shape. On the other hand, when the deviation is larger than 150, agglomerated particles are present in the small amount and, therefore, it becomes difficult to attain the object of the present invention. In this case, the measurement is also performed with respect to randomly chosen 100 to 200 fine particles of chitosan.

In the present invention, it is more preferred to simultaneously satisfy the first and second aspects.

According to the third aspect of the chitosan-containing acrylic fibers of the present invention, a quaternary ammonium salt is contained in the fibers, together with chitosan. Surprisingly, with this construction, the softness obtained by containing chitosan becomes permanent. That is, in this aspect, 0.05–2% by weight of chitosan is contained and a quaternary ammonium salt is contained in the amount which is larger than the chitosan content and not more than 3% by weight.

When the content of the quaternary ammonium salt is smaller than the chitosan content, the softness is deteriorated and, at the same time, the effects such as stabilization of dispersion of chitosan in the step of immersing in a mixed solution of chitosan and a quaternary ammonium salt, and inhibition of hang-up of the fibers at the time of densification with drying are decreased. On the other hand, when the content exceeds 3% by weight, deterioration of the dyeability or deterioration of the operatability due to elimination of the quaternary ammonium salt in the spinning step are caused.

Use of chitosan in combination with the quaternary ammonium salt has an advantage that stable dispersion of chitosan is maintained in the step of immersing in the mixed solution of chitosan and the quaternary ammonium salt and, furthermore, it becomes possible to inhibit hang-up of the fibers in the step of densifying with drying.

To maintain the antimicrobial activity by chitosan even when subjected to posttreatments such as dyeing and bleaching, and a treatment such a washing, and to facilitate stable dispersion of chitosan in the production step, particularly, a compound represented by the general formula (I):

$$[R_1R_2R_3R_4N]^+{}_aX^{a-} \quad \text{(I)}$$

(wherein $R_1$ to $R_4$ independently represent an optionally substituted alkyl group having 1 to 18 carbon atoms; X represents a halogen ion, an organic acid anion or an oxo-acid ion; and "a" represents a valence of X) is preferably used as the quaternary ammonium salt.

The organic acid anion includes, for example, carboxylate ion, sulfonate ion, sulfate ion, phosphate ion and phosphonate ion. In case of the anion having two or more valences, a portion thereof may be esterified. Among them, carboxylate and sulfonate are particularly preferred. The use of the organic acid anion is preferred because rusting is prevented in posttreatments such as spinning step. The oxo-acid ion includes, for example, perchlorate ion or the like.

As X, for example, chlorine ion; bromine ion; $C_2$–$C_8$ aliphatic monocarboxylate ion such as acetate ion and propionate ion; $C_3$–$C_8$ aliphatic dicarboxylate ion such as succinate ion and adipate ion; $C_1$–$C_{12}$ alkylsulfonate ion such as methylsulfonate ion and ethylsulfonate ion; arylsulfonate ion such as benzenesulfonate ion; and substituted $C_2$–$C_{18}$, carboxylate ion such as oxyacetate ion, tartrate ion and gluconate ion.

As the substituent for $R_1$ to $R_4$, for example, hydroxyl group and $C_1$–$C_{20}$ alkylcarbonyl amino are preferred.

As $R_1$ to $R_4$, for example, $C_1$–$C_{18}$ non-substituted alkyl group, $C_1$–$C_8$ alkyl group substituted with a hydroxyl group, and $C_1$–$C_8$ alkyl group substituted with a $C_1$–$C_{20}$ alkylcarbonylamino group are particularly preferred.

As the quaternary ammonium salt, for example, didecyldimethylammonium chloride, dihydroxyethyldecylethylammonium chloride, N-hydroxyethyl N,N-dimethyl N-stearylamideethylammonium ethylsulfonate, bis (didecyldimethylammonium)adipate and didecyldimethylammonium gluconate are preferably used.

The chitosan-containing acrylic fibers containing the quaternary ammonium salt, together with chitosan, maintains low coefficient of static friction between the fibers even if the process lubricant is removed by a treatment in boiling water for 30 minutes. This fact means that the coefficient of static friction between the fibers is small even after washing the fiber product and the softness is maintained. In case that the fibers are used in the final fiber product in the proportion of not less than 70% by weight, the amount of a textile softener used normally in the finishing step can be reduced.

In the present invention, the third aspect may be used in combination with the first or second aspect. Alternatively, the third aspect may be used in combination with both first and second aspects.

The chitosan-containing acrylic fibers of the present invention are used alone or in combination of other fibers, thereby making it possible to use as a spun yarn, woven cloth and nonwoven fabric. In case of using in combination with other fibers, the chitosan-containing acrylic fibers of the present invention are preferably mixed in the proportion of not less than 20% by weight to obtain the antimicrobial activity. To simultaneously obtain the antimicrobial activity and softness, the chitosan-containing acrylic fibers according to the aspect wherein a quaternary ammonium salt is contained, together with chitosan, are preferably mixed in the proportion of not less than 70% by weight. The fiber used mixedly with the chitosan-containing acrylic fibers of the present invention may be selected according to the purpose and is not specifically limited, and examples thereof include known fibers such as normal acrylic fibers, cotton fibers, rayon fibers, wool fibers, hemp fibers, silk fibers and polyester fibers.

The process for preparing the chitosan-containing acrylic fibers of the present invention will be described hereinafter.

The first aspect of the process of the present invention comprises the steps of performing wet spinning of an acrylonitrile polymer solution to obtain water-swollen acrylic fibers; immersing a yarn of the water-swollen acrylic fibers in an aqueous acidic chitosan solution; and densifying the yarn of the water-swollen acrylic fibers containing chitosan with drying.

First, in order to perform wet spinning of the acrylonitrile polymer solution, the above solution of the acrylonitrile polymer is ejected into a solidifying bath through a nozzle to obtain fibers. As a solvent in which the acrylonitrile polymer is dissolved, there can be used those used normally in spinning of normal acrylic fibers. Examples thereof include organic solvents such as dimethylacetamide, dimethylformamide and dimethyl sulfoxide; and aqueous concentrated solution of inorganic materials such as nitric acid, sodium rhodanide and zinc chloride. Taking the formation of microvoids of the yarn of the acrylic fibers into consideration, the organic solvent is preferred, and dimethylacetamide, dimethylformamide or dimethyl sulfoxide is most preferred.

In the present invention, the yarn in the form of fibers is washed to remove the solvent. If necessary, stretching of the yarn is performed, simultaneously or separately with the washing. In the first aspect of the process of the present invention, the yarn to be immersed in the aqueous acidic chitosan solution is in the water-swollen state, and maybe a yarn in any stage, for example, stage of a solidified yarn after spinning, stage of a washed yarn after removing the solvent, or a stage of a stretched yarn after stretching, as far as the yarn is the stage before densified with drying.

Chitosan is dissolved in the presence of an acid, thereby to form a salt. On the other hand, microvoids are present in the yarn of the water-swollen acrylic fibers, and the fiber texture is not dense but soft. Therefore, according to the present invention, by immersing the water-swollen acrylic fibers in the aqueous acidic solution of chitosan, chitosan is incorporated by penetrating into the fibers. Accordingly, according to this process, the surface and internal distribution of chitosan as well as particle diameter of chitosan can be easily controlled and, therefore, elimination of chitosan in posttreatments, and treatments in service environments such as washing as well as inactivation of the antimicrobial/deodorizing activities of chitosan can be prevented.

As an index representing comparatively the water-swollen state, that is, the state of microvoids and imperfect fiber texture, water swelling degree can be used.

The measurement of the water swelling degree is performed by determining the amount of water penetrated into the fibers from a difference between the weight in the swollen state after the water-swollen fibers are centrifuged to remove water adhered on the surface or between the fibers, and the weight of the fibers after absolute drying.

In the present invention, the water swelling degree of the acrylic fibers used in immersing in the aqueous acidic chitosan solution is from 30 to 200%. By controlling the water swelling degree to not less than 30%, chitosan penetrates into the yarn of the fibers and, therefore, elimination of chitosan hardly arises and the resistance of the antimicrobial activity is superior. By controlling the water swelling degree to not more than 200%, the amount of water of the yarn to be incorporated is small and it is preferred in view of the manufacturing process.

Under these conditions, there can be easily prepared the chitosan-containing acrylic fibers of the first aspect of the present invention, that is, chitosan-containing acrylic fibers having a total chitosan content of 0.05 to 2% by weight and an extractable chitosan content of not less than 0.03% by weight to less than the total chitosan content. Particularly, a difference between the total chitosan content and extractable chitosan content can be easily controlled within a range from 0.03 to 0.8% by weight.

It is also possible to easily control so that the chitosan-containing acrylic fibers of the second aspect of the present invention is attained, that is, an equivalent-circle average diameter of the fine particles in a cross section of the fibers is from 1 to 100 nm and, particularly, an average of a shape factor SF is from 100 to 300 and its standard deviation is not more than 150.

The concentration of chitosan in the aqueous acidic chitosan solution is about not more than 5% by weight at which chitosan can be easily dissolved, and is appropriately changed so that the amount of chitosan to be incorporated is a predetermined amount. The kind of the acid is not specifically limited, but hydrochloric acid, acetic acid, lactic acid and formic acid can be preferably used. To avoid corrosion of the device, the concentration of the acid is preferably low as possible within a range at which chitosan can be dissolved.

The immersing time and immersing temperature of the acrylic fibers can be appropriately changed so that the predetermined chitosan content, chitosan dispersion state and other required physical properties can be obtained.

If necessary, the acrylic fibers after immersing in the aqueous acidic chitosan solution may be neutralized by immersing in an aqueous alkali solution. As the aqueous alkali solution, for example, a diluted solution of sodium hydroxide, sodium bicarbonate or the like is used.

To avoid the problems in the post step, for example, hang-up in the drying step, a treatment using a process lubricant is performed by passing the acrylic fibers through a bath filled with a solution comprising a process lubricant containing a surfactant such as polyoxyethylene, ethylene oxide polypropylene oxide block polyether or the like, if necessary. It is also possible to simultaneously perform incorporation of chitosan and treatment using the process lubricant by containing chitosan and the process lubricant in the same solution.

Thereafter, the acrylic fibers are densified with drying by a conventional process to obtain chitosan-containing acrylic fibers.

The second aspect of the process of the present invention comprises the steps of performing wet spinning of an acrylonitrile polymer solution to obtain water-swollen acrylic fibers; immersing a yarn of the water-swollen acrylic fibers in a mixed solution of chitosan and a quaternary ammonium salt, or immersing a yarn in a solution of a quaternary ammonium salt after immersing the yarn in an aqueous acidic chitosan solution; and densifying the yarn with drying.

The step of performing wet spinning of the acrylonitrile polymer solution to obtain water-swollen acrylic fibers is the same as that of the first aspect. When the water-swollen acrylic fibers are immersed in a solution containing a quaternary ammonium salt, the quaternary ammonium salt is also incorporated by penetrating into the fibers and, therefore, low coefficient of static friction between the fibers can be maintained for a long period of time, together with the antimicrobical activity. At that time, the water swelling degree is preferably from 30 to 200%.

In case that the treatment by using chitosan and a quaternary ammonium salt is performed by immersing the water-swollen acrylic fibers in a mixed solution of chitosan and a quaternary ammonium salt, it is advantageous because the step is simplified and the stability of the chitosan solution is enhanced. On the other hand, in case that the treatment is performed by immersing in a solution of the quaternary ammonium salt after immersing in the aqueous acidic chitosan solution, it is advantageous because the control of the step becomes easier and the degree of impregnation of chitosan in the fibers can be independently controlled.

As the aqueous acidic chitosan solution, the same aqueous acidic chitosan solution as that described in the first aspect of the present invention can be used. The mixed solution of chitosan and a quaternary ammonium salt contains both chitosan and quaternary ammonium salt in the same solution. The concentration of chitosan and that of the quaternary ammonium salt are appropriately changed so that the amount of chitosan or quaternary ammonium salt to be incorporated becomes a predetermined amount.

The immersing time and immersing temperature of the acrylic fibers can be appropriately changed so that the predetermined chitosan or quaternary ammonium salt content, chitosan dispersion state and other required physical properties can be obtained.

In this aspect, the treatment using a process lubricant may be separately performed, but adhesion of the quaternary ammonium salt and treatment using a process lubricant may also be performed, simultaneously, by containing the process lubricant in the bath of the solution of the quaternary ammonium salt. The treatment of the acrylic fibers before densifying with drying by adding the process lubricant to the quaternary ammonium salt solution is preferred because permanent softness becomes more remarkable. In this case, adhesion of chitosan may also be performed at the same time.

In addition to the quaternary ammonium salt, a cationic or nonionic surfactant can be used in combination.

Thereafter, the acrylic fibers are densified with drying in the same manner as that of the first aspect of the process, thereby making it possible to obtain chitosan-containing acrylic fibers.

EXAMPLES

The following Examples further illustrate the present invention in detail. In the Examples, "%"s are by weight unless otherwise stated.

<Method for measurement of water swelling degree of yarn of acrylic fibers>

The water swelling degree was calculated from the weight W1 of a yarn of acrylic fibers after removing water from the yarn, which is collected from the spinning step before it is densified with drying, under an acceleration of 1000 G and W2 of the yarn after hot-air drying at 110√ C. for 3 hours by using the following formula.

$$(\text{Water swelling degree})=\{(W1-W2)/W2\}\times 100(\%)$$

<Method for measurement of total chitosan content, method A>

(1) To 0.2 g of weighed acrylic fibers, 10 ml of a 70% zinc chloride solution was added, thereby to dissolve the fibers.

(2) 2 ml of diacetylamide was added and the mixture was allowed to stand for 1 hour.

(3) 1 ml of an Ehrlich reagent (1% ethanol solution of p-dimethylaminobenzaldehyde) was added.

(4) After 2 hours, the absorbance of the solution of (3) was measured at a wavelength of 435 nm.

The chitosan concentration was determined from a working curve and was reduced to give a content in acrylic fibers.

<Method for measurement of extracted chitosan content, method B>

(1) 5 g of weighed chitosan-containing acrylic fibers are immersed in 100 ml of 6M hydrochloric acid and then heated in boiling water for 8 hours.

(2) After removing the acrylic fibers, 25 ml of the resulting extracted chitosan extract solution is concentrated to dryness under reduced pressure while adding 150 ml of distilled water.

(3) The dried substance is dissolved in 10 ml of a 10% acetic acid solution. To the solution, 1 ml of an Ehrlich reagent (1% ethanol solution of p-dimethylaminobenzaldehyde) is added and the mixed solution is allowed to stand at 5° C. for 12 hours.

(4) The absorbance of the solution of (3) was measured at a wavelength of 435 nm.

(5) The chitosan concentration is determined from a working curve and is reduced to give a content in acrylic fibers.

<Method for measurement of quaternary ammonium salt content>

The acrylic fibers were dissolved in DMSO-$d_6$ so that the resulting solution has a concentration of 4% and $^1$H-NMR was measured. Then, the content in the fibers was determined from an area ratio of a peak derived from an acrylonitrile polymer to a peak derived from a quaternary ammonium salt.

<Reduction viscosity of polymer>

Regarding the reduction viscosity η red of the acrylonitrile polymer, the viscosity of a polymer solution obtained by dissolving the acrylonitrile polymer in dimethylformamide so that the resulting solution has a concentration of 0.5% was measured by using a Canon Fenske viscometer.

<Measurement of antimicrobial activity>

According to the following method for measurement of cell number defined by Fiber Product New Function Evaluation Conference (old name: Fiber Product Sanitary Processing Conference), a difference in change of cell number was measured.

A sample cloth is sterilized at 121° C. for 15 minutes and inoculation is performed by pouring a predetermined amount of a bouillon suspension of *Staphylococcus aureus*. The sample cloth is transferred to a sealed vessel and, after cultivating at 37° C. for 18 hours, the viable cell number is measured. A difference between the viable cell number and the inoculated cell number (=Log (viable cell number)—Log (inoculated cell number)) was determined and a difference between this sample and a no-processed sample is taken as a difference in change of cell number.

The difference in change of cell number of not less than 1.6 was taken as criteria of effective antimicrobial activity. Washing was performed according to the method defined by the same conference.

<Coefficient of static friction between fibers>

The coefficient of static friction between the fibers was measured by using a radar method fiber friction coefficient measuring device (manufactured by Koa Shokai).

Examples 1–7 and Comparative 1–2

By using an aqueous dispersion polymerization method, an acrylonitrile polymer (weight ratio of acrylonitrile to vinyl acetate =93/7) having a reduction viscosity of 1.96 was obtained. This acrylonitrile polymer was dissolved in dimethylacetamide so that the resulting solution has a copolymer concentration of 25%, thereby to obtain a spinning stock solution.

Wet spinning of this spinning stock solution was performed in a spinning bath filled with an aqueous 30% dimethylacetamide at 40° C. and then stretched by five times while washing the solvent in boiling water. Subsequently, the stretched yarns having a swelling degree of 80% were immersed in a bath filled with aqueous acetic acid solutions having concentration of chitosan (Flownak C, manufactured by Kyowa Technos Co., Ltd.) ranging from 0.01 to 3%, and then dehydrated so that a ratio of the content of water adhered to the weight of the fibers is 100%. Then, the stretched yarn were densified with drying using a hot roller at 150° C.

The resulting yarns were subjected to a relaxation treatment in a pressurized steam at 2.5 kg/cm$^2$ to obtain chitosan-containing acrylic fibers having a single fiber fineness of 3 denier. The total chitosan content and extracted chitosan content in the fibers were measured by using the above method. The separation of chitosan in a finish bath and hang-up of the fibers in the step of densifying with drying were not recognized.

The resulting fibers were treated in boiling water in a bath ratio (fiber:water) of 1:50 for 30 minutes, washed with water and air-dried, and then the coefficient of static friction between the fibers was measured.

The fibers were cut in pieces having a length of 51 mm, thereby to make a spun yarn. 50 g of this spun yarn, 0.25 g of a dye (Catilon Blue KGLH, manufactured by Hodogaya Kagaku Co., Ltd.), 1 g of acetic acid and 0.25 g of sodium acetate were added in 1000 g of purified water, followed by heating to 100° C. After maintaining at the same temperature for 30 minutes, the spun yarn was washed with water, dehydrated and then dried. For the spun yarn after drying, the color developing clarity was evaluated by visual judgement and, at the same time, the antimicrobial activity was evaluated before washing and after washing ten times. The measurement and determination results are summarized in Table 1.

Comparative Example 3

In the same manner as that described in Example 1, except that an aqueous acetic acid solution containig 0.1% of chitosan was sprayed to acrylic fibers densified with drying without being immersed in a chitosan/acetic acid solution and the acrylic fibers were dried by using a roller at 150° C., acrylic fibers having a total chitosan content of 0.06% and an extracted chitosan content of 0.05% were obtained. The resulting acrylic fibers were subjected to the same treatment as that described in Example 1 to make a spun yarn, and then the antimicrobial activity was evaluated. The results are also shown in Table 1.

Examples 8–11

By using an aqueous dispersion polymerization method, an acrylonitrile polymer (weight ratio of acrylonitrile to vinyl acetate=93/7) having a reduction viscosity of 1.85 was dissolved in dimethylacetamide so that the resulting solution has a copolymer concentration of 25%, thereby to obtain a spinning stock solution.

Each wet spinning using this spinning stock solution was performed in each spinning bath, where the concentration and temperature of the aqueous dimethylacetamide solution are varied, then the yarns were stretched by five times while washing the solvent in boiling water. Subsequently, the stretched yarns having a swelling degree of 100, 60, 40 or 130% were immersed in a bath filled with an aqueous chitosan (Flownak C, manufactured by Kyowa Technos Co., Ltd.)/0.1% acetic acid solution, and then dehydrated so that a ratio of the content of water adhered to the weight of the fibers is 100%. Then, the stretched yarn was densified with drying using a hot roller at 150° C.

The resulting acrylic fibers were subjected to the same treatment as that described in Example 1 to make each spun yarn, and then the antimicrobial activity was evaluated. The results are also shown in Table 1.

Comparative Examples 4–5

Wet spinning of this spinning stock solution whose concentration was adjusted to 28% or 18% was performed in a spinning bath filled with an aqueous 30% dimethylacetamide solution, and then stretched by five times while washing the solvent in boiling water. Subsequently, the stretched yarn having a swelling degree of 250% (Comparative Example 4) or 20% (Comparative Example 5) was subjected to the same treatment as that described in Example 8 to make a spun yarn, and then the antimicrobial activity was evaluated. The results are also shown in Table 1.

Example 12

By using an aqueous dispersion polymerization method, an acrylonitrile polymer (weight ratio of acrylonitrile to vinyl acetate=93/7) having a reduction viscosity of 1.96 was obtained. This acrylonitrile polymer was dissolved in dimethylacetamide so that the resulting solution has a copolymer concentration of 25%, thereby to obtain a spinning stock solution.

Wet spinning of this spinning stock solution was performed in a spinning bath filled with an aqueous 30% dimethylacetamide at 40° C. and then stretched by five times while washing the solvent in boiling water. Subsequently, the stretched yarn having a swelling degree of 80% was immersed in a finish bath containing 0.1% of chitosan (Flownak C, manufactured by Kyowa Technos Co., Ltd.), 0.05% of acetic acid, 0.35% of didecyldimethylammonium chloride as a quaternary ammonium salt and 0.3% of a surfactant polyoxyethylene (polymerization degree: 200) as a process lubricant, and then dehydrated so that a ratio of the content of water adhered to the weight of the fibers is 100%. Then, the stretched yarn was densified with drying using a hot roller at 150° C.

The resulting yarn was subjected to a relaxation treatment in a pressurized steam at 2.5 kg/cm$^2$ to obtain chitosan-containing acrylic fibers having a single fiber fineness of 3 denier, The total chitosan content and quaternary ammonium salt content in the fibers were measured by using the above method. As a result, they are 0.08% and 0.33%, respectively. The separation in a finish bath and hang-up of the fibers in the step of densifying with drying were not recognized.

The resulting fibers were treated in boiling water in a bath ratio (fiber:water) of 1:50, washed with water and air-dried, and then the coefficient of static friction between the fibers was measured. As a result it was 0.285.

The fibers were cut in pieces having a length of 51 mm, thereby to make a spun yarn. 50 g of this spun yarn, 0.25 g of a dye (Catilon Blue KGLH, manufactured by Hodogaya Kagaku Co., Ltd.), 1 g of acetic acid and 0.25 g of sodium acetate were added in 1000 g of purified water, followed by heating to 100°C. After maintaining at the same temperature for 30 minutes, the spun yarn was washed with water, dehydrated and then dried. For the spun yarn after drying, the color developing clarity was evaluated by visual judgement and, at the same time, the antimicrobial activity was evaluated before washing and after washing ten times. The measurement and determination results are summarized in Table 2.

Examples 13–15 and Comparative Examples 6–8

In the same manner as that described in Example 12, except that the chitosan concentration, acetic acid concentration and surfactant concentration in the finish bath as well as the content of water adhered after immersing in the aqueous chitosan acidic solution were changed stepwise, acrylic fibers having different chitosan contents and didecyldimethylammonium chloride contents were obtained. The separation in a finish bath and hang-up of the fibers in the step of densifying with drying were not recognized. In the same manner as that described in Example 12, the coefficient of static friction between the fibers and antimicrobial activity were evaluated. As a result, the results are as shown in Table 2.

Regarding the staple (Comparative Example 7) having a chitosan content of 2.4% and a didecyldimethylammonium chloride content of 2.88% and the staple (Comparative Example 8) having a chitosan content of 0.4% and a didecyldimethylammonium chloride content of 3.25%, the amount of chitosan to be adhered to the spinning/drying roller and the spinning step is large and, therefore, a spun yarn could not be obtained.

Comparative Example 9

In the same manner as that described in Example 12, except that the water-swollen acrylic fibers were immersed in a finish bath containing 0.2% of dimethyldidecylammonium chloride and 0.2% of polyoxyethylene as the process lubricant without containing chitosan in the finish bath, acrylic fibers having a single fiber fineness of 3 denier were obtained. The coefficient of static friction between the fibers measured in the same manner as that described in Example 12 was 0.455.

A colored spun yarn was made from the resulting fibers in the same manner as that described in Example 1 and the antimicrobial activity was evaluated before washing and after washing ten times, after dyeing. As is shown in Table 2, the antimicrobial activity was not exerted.

Example 16

A spun yarn was made by mixing 30% of the acrylic fibers obtained in Example 12 with 70% of cotton. Cationic dyeing of the resulting spun yarn was performed under the same conditions as those of Example 1, and then the antimicrobial activity was evaluated before washing and after washing ten times. As a result, it was 2.8 and 1.9, respectively.

Example 17

In the same manner as that described in Example 12, except that the quaternary ammonium salt and surfactant in the finish bath were changed to dihydroxyethyldecylethylammonium chloride of 0.3% in concentration and polyoxyethylene (polymerization degree: 200) of 0.3% in concentration, respectively, acrylic fibers were obtained. The chitosan content was 0.09% and the content of dihydroxyethyldecylethylammonium chloride was 0.29%. Furthermore, the coefficient of static friction between the fibers was 0.320, and the antimicrobial activity was 2.8 before washing, or 2.2 after washing ten times.

Example 18

In the same manner as that described in Example 12, except that the quaternary ammonium salt and surfactant in the finish bath were changed to N-hydroxyethyl N,N-dimethyl N-stearylamideethylammoniumethyl sulfonate of 0.4% in concentration and ethylene oxide propylene oxide block polyether (polyethylene oxide/propylene oxide=40/60, molecular weight: 5000) of 0.2% in concentration, respectively, acrylic fibers were obtained. The chitosan content in raw cotton was 0.09% and the content of N-hydroxyethyl N,N-dimethyl N-stearylamideethylammoniumethyl sulfonate was 0.38%. Furthermore, the coefficient of static friction between the fibers was 0.290, and the antimicrobial activity was 2.6 before washing, or 2.0 after washing ten times.

Example 19

In the same manner as that described in Example 12, except that the concentration of chitosan (Flownak C, manufactured by Kyowa Technos Co., Ltd.), that of acetic acid and that of didecyldimethylammonium chloride in the finish bath were respectively adjusted to 0.1%, 0.05% and 0.35% and the concentration of ethylene oxide propylene oxide block polyether (ethylene oxide/propylene oxide=40/60, molecular weight: 5000) was adjusted to 0.2% in the bath for treating using the process lubricant, acrylic fibers were obtained. The chitosan content was 0.09% and the content of didecyldimethylammonium chloride adhered was 0.32%. Furthermore, the coefficient of static friction between the fibers was 0.295, and the antimicrobial activity was 5.0 before washing, or 4.8 after washing ten times.

Examples 20–21

In the same manner as that described in Example 19, except that the concentration of didecyldimethylammonium chloride was changed, acrylic fibers were obtained. The results are shown in Table 2.

Example 22

In Example 12, the water-swollen acrylic fibers were immersed in the mixed solution of chitosan and quaternary ammonium salt, whereas, in this Example, immersion in an aqueous acidic solution of chitosan and immersion in a solution of quaternary ammonium salt were separately performed. That is, in the same manner as that described in Example 12, except that the acrylic fibers were immersed in an immersion bath containing 0.1% of chitosan (Flownak C, manufactured by Kyowa Technos Co., Ltd.) and 0.05% of acetic acid and then immersed in a finish bath containing 0.35% of didecyldimethylammonium chloride and 0.3% of polyoxyethylene (polymerization degree: 200) as the process lubricant, acrylic fibers were obtained. Furthermore, the coefficient of static friction between the fibers and the antimicrobial activity were evaluated. The results are as shown in Table 2.

Examples 23–25 and Comparative Examples 10,11

In the same manner as that described in Example 22, except that the concentration of chitosan in the chitosan solution bath and that of didecyldimethylammonium chloride in the finish bath were changed stepwise, acrylic fibers were obtained. Furthermore, the coefficient of static friction between the fibers and the antimicrobial activity were evaluated. The results are as shown in Table 2.

Regarding the staple (Comparative Example 11) having a chitosan content of 2.48% and a didecyldimethylammonium chloride content of 2.96%, the amount of chitosan to be adhered to the spinning/drying roller and the spinning step is large and, therefore, a spun yarn could not be obtained.

Example 26

A spun yarn was made by mixing 30% of the acrylic fibers obtained in Example 22 with 70% of cotton. Cationic dyeing of the resulting spun yarn was performed under the same conditions as those of Example 1, and then the antimicrobial activity was evaluated before washing and after washing ten times. As a result, it was 3.1 and 2.4, respectively.

Example 27

In the same manner as that described in Example 22, except that the quaternary ammonium salt and surfactant in the finish bath were changed to dihydroxyethyldecylethylammonium chloride of 0.3% in concentration and polyoxyethylene (polymerization degree: 200) of 0.3% in concentration, respectively, acrylic fibers were obtained. The chitosan content in the fiber was 0.1% and the content of dihydroxyethyldecylethylammonium chloride was 0.29%. Furthermore, the coefficient of static friction between the fibers was 0.334, and the antimicrobial activity was 4.26 before washing, or 3.5 after washing ten times.

Example 28

In the same manner as that described in Example 22, except that the quaternary ammonium salt and surfactant in the finish bath were changed to N-hydroxyethyl N,N-dimethyl N-stearylamideethylammoniumethyl sulfonate of 0.4% in concentration and ethylene oxide propylene oxide block polyether (polyethylene oxide/propylene oxide=40/60, molecular weight: 5000) of 0.2% in concentration, respectively, acrylic fibers were obtained. The chitosan content in the fiber was 0.1% and the content of N-hydroxyethyl N,N-dimethyl N-stearylamideethylammoniumethyl sulfonate was 0.40%. Furthermore, the coefficient of static friction between the fibers was 0.298, and the antimicrobial activity was 3.2 before washing, or 2.3 after washing ten times.

Example 29

In the same manner as that described in Example 22, except that the concentration of chitosan (Flownak C, manufactured by Kyowa Technos Co., Ltd.), that of acetic acid and that of didecyldimethylammonium chloride in the finish bath were respectively adjusted to 0.1%, 0.05% and 0.35% and the concentration of ethylene oxide propylene oxide block polyether (ethylene oxide/propylene oxide=40/60, molecular weight: 5000) was adjusted to 0.2% in the bath for treating using the process lubricant, acrylic fibers were obtained. The chitosan content in raw cotton was 0.1% and the content of didecyldimethylammonium chloride was 0.32%. Furthermore, the coefficient of static friction between the fibers was 0.295, and the antimicrobial activity was 5.0before washing, or 4.8 after washing ten times.

Example 30

In the same manner as that described in Example 22, except that the quaternary ammonium salt in the finish bath was changed to bis(didecyldimethylammonium)adipate of 0.4% in concentration, acrylic fibers were obtained. The chitosan content in the fiber was 0.1% and the content of bis(didecyldimethylammonium)adipate was 0.39%. Furthermore, the coefficient of static friction between the fibers was 0.287, and the antimicrobial activity was 4.8 before washing, or 4.4 after washing ten times.

Example 31

In the same manner as that described in Example 22, except that the quaternary ammonium salt in the finish bath was changed to didecyldimethylammonium gluconate of 0.5% in concentration, acrylic fibers were obtained. The chitosan content in the fiber was 0.1% and the content of didecyldimethylammonium gluconate was 0.47%. Furthermore, the coefficient of static friction between the fibers was 0.269, and the antimicrobial activity was 5.2 before washing, or 4.5 after washing ten times.

TABLE 1

| | Preparing conditions | Chitosan content | | | Dispersion state of chitosan in cross section of fibers | | | | | Difference in change of cell number | | Coefficient of | |
|---|---|---|---|---|---|---|---|---|---|---|---|---|---|
| | Swelling degree % | Total chitosan content (A) % | Extracted chitosan content (B) % | A-B % | Measurement number | Average diameter nm | σ nm | SF | σ | Before washing | After washing ten times | friction between fibers | Dyeing clarity |
| Comp-Ex 1 | 80 | 0.03 | 0.01 | 0.02 | 120 | 1.7 | 2.3 | 200 | 68 | 0.8 | 0.7 | 0.385 | Good |
| Example 1 | 80 | 0.06 | 0.03 | 0.03 | 100 | 2.9 | 2.1 | 230 | 80 | 1.8 | 1.7 | 0.33 | Good |
| Example 2 | 80 | 0.1 | 0.03 | 0.07 | 100 | 5.4 | 3.7 | 270 | 95 | 2 | 1.9 | 0.31 | Good |
| Example 3 | 80 | 0.2 | 0.06 | 0.14 | 100 | 7.4 | 4 | 280 | 100 | 5.4 | 5.2 | 0.29 | Good |
| Example 4 | 80 | 0.3 | 0.1 | 0.2 | 100 | 10.6 | 4.8 | 250 | 130 | 5.4 | 5.2 | 0.28 | Good |
| Example 5 | 80 | 0.9 | 0.5 | 0.4 | 100 | 26.8 | 10.4 | 270 | 120 | 5.5 | 5.3 | 0.27 | Good |
| Example 6 | 80 | 1.0 | 0.6 | 0.4 | 100 | 30.1 | 12.7 | 280 | 110 | 5.4 | 5.4 | 0.255 | Good |
| Example 7 | 80 | 1.5 | 0.9 | 0.6 | 100 | 45.9 | 25.9 | 260 | 50 | 5.4 | 5.4 | 0.26 | Good |
| Comp-Ex 2 | 80 | 2.8 | 2 | 0.8 | 100 | 98.6 | 46.8 | 300 | 150 | 5.5 | 5.4 | 0.255 | Slightly poor |
| Comp-Ex 3 | — | 0.06 | 0.05 | 0.01 | 100 | Fine particles of chitosan were not detected therein. | | | | 1.7 | 0.7 | 0.34 | Good |
| Example 8 | 100 | 0.1 | 0.03 | 0.07 | 185 | 3.5 | 3.2 | 240 | 95 | 5.1 | 4.9 | 0.365 | Good |
| Example 9 | 60 | 0.1 | 0.05 | 0.05 | 165 | 2.2 | 2 | 190 | 80 | 5.3 | 5.1 | 0.312 | Good |
| Example 10 | 40 | 0.1 | 0.06 | 0.04 | 170 | 2 | 1.9 | 180 | 80 | 5.2 | 5 | 0.298 | Good |
| Example 11 | 130 | 0.1 | 0.03 | 0.07 | 180 | 7.5 | 9.8 | 280 | 110 | 4.8 | 4.1 | 0.384 | Good |
| Comp-Ex 4 | 250 | 0.1 | 0.02 | 0.08 | 150 | 12.5 | 23.8 | 315 | 305 | 5.5 | 1.5 | 0.396 | Good |
| Comp-Ex 5 | 20 | 0.1 | 0.07 | 0.03 | 195 | 0.6 | 0.5 | 155 | 85 | 5.5 | 1.2 | 0.255 | Good |

Comp-Ex: Comparative Example
σ: Standard deviation

TABLE 2

| | Chitosan content | | | Quarter-nary | Fiber- | difference in change of cell number | | |
|---|---|---|---|---|---|---|---|---|
| | Total chitosan content (A) % | Extracted chitosan content (B) % | A-B % | ammonium salt content % | fiber friction coeffi-cient | Before washing | After washing ten times | Dye-ing clarity |
| Ex 12 | 0.09 | 0.05 | 0.04 | 0.33 | 0.285 | 5.1 | 4.8 | ⊙ |
| Ex 13 | 0.25 | 0.17 | 0.08 | 0.42 | 0.275 | 5.4 | 5.2 | ⊙ |
| Ex 14 | 1.0 | 0.65 | 0.35 | 1.05 | 0.260 | 5.5 | 5.2 | ⊙ |
| Ex 15 | 1.6 | 1.00 | 0.6 | 1.67 | 0.265 | 5.5 | 5.3 | ○ |
| Ex 17 | 0.09 | 0.05 | 0.04 | 0.29 | 0.320 | 2.8 | 2.2 | ⊙ |
| Ex 18 | 0.09 | 0.05 | 0.04 | 0.38 | 0.290 | 2.6 | 2.0 | ⊙ |
| Ex 19 | 0.09 | 0.05 | 0.04 | 0.32 | 0.295 | 5.0 | 4.8 | ⊙ |
| Ex 20 | 0.09 | 0.05 | 0.04 | 0.34 | 0.293 | 5.3 | 4.5 | ⊙ |
| Ex 21 | 0.09 | 0.05 | 0.04 | 0.37 | 0.275 | 5.0 | 4.3 | ⊙ |
| Ex 22 | 0.1 | 0.07 | 0.03 | 0.35 | 0.283 | 5.1 | 4.8 | ⊙ |
| Ex 23 | 0.25 | 0.16 | 0.09 | 0.48 | 0.287 | 5.5 | 5.1 | ⊙ |
| Ex 24 | 1.03 | 0.67 | 0.36 | 1.02 | 0.274 | 5.3 | 5.1 | ⊙ |
| Ex 25 | 1.51 | 0.97 | 0.54 | 1.67 | 0.265 | 5.5 | 5.2 | ○ |
| Ex 27 | 0.1 | 0.06 | 0.04 | 0.29 | 0.334 | 4.2 | 3.5 | ⊙ |
| Ex 28 | 0.1 | 0.06 | 0.04 | 0.40 | 0.298 | 3.2 | 2.3 | ⊙ |
| Ex 29 | 0.1 | 0.08 | 0.04 | 0.32 | 0.295 | 5.0 | 4.8 | ⊙ |
| Ex 30 | 0.1 | 0.06 | 0.04 | 0.39 | 0.287 | 4.8 | 4.4 | ⊙ |
| Ex 31 | 0.1 | 0.06 | 0.04 | 0.47 | 0.269 | 5.2 | 4.5 | ⊙ |
| Cp-Ex 6 | 0.04 | 0.02 | 0.02 | 0.31 | 0.380 | 2.2 | 1.2 | ⊙ |
| Cp-Ex 7 | 2.4 | 1.38 | 1.02 | 2.88 | 0.375 | X[a] | X[a] | X[a] |
| Cp-Ex 8 | 0.4 | 0.26 | 0.14 | 3.25 | 0.378 | X | X | X |
| Cp-Ex 9 | 0 | | | 0.25 | 0.455 | 2.8 | 0.9 | ⊙ |
| Cp-Ex 10 | 0.06 | 0.04 | 0.02 | 0.29 | 0.388 | 4.1 | 3.5 | ⊙ |
| 比較例 11 | 2.48 | 1.44 | 1.04 | 2.96 | 0.367 | X | X | X |

Ex: Example
Cp-Ex: Comparative Example
[a]Symbol "X" in the column of difference in change of cell number and dyeing clarity means that evaluation could not be performed because no spun yarn could not be obtained.
Symbols "⊙" and "○" in the column of dyeing clarity mean "Excellent" and "Good", respectively.

INDUSTRIAL APPLICABILITY

According to the present invention, there can be obtained acrylic fibers wherein the antimicrobial activity is not deteriorated even when subjected to posttreatments, such as dyeing and bleaching of fibers, and treatments in usual service environments of fiber products, such as washing and ironing. In case that the fibers of the present invention is used in final fiber products in the proportion of not less than 70%, the amount of a textile softener to be used in the final finishing step can be remarkably reduced because the fibers of the present invention has softness. According to the present invention, the above fibers can be efficiently prepared.

What is claimed is:

1. Chitosan-containing acrylic fibers having a total chitosan content of 0.05 to 2% by weight and an extractable chitosan content of not less than 0.03% by weight, a difference between the total chitosan content and extractable chitosan content being from 0.03 to 0.8% by weight, wherein chitosan is dispersed in the fibers in the form of fine particles and an equivalent-circle average diameter of the fine particles in a cross section is from 1 to 100 nm, and wherein an average of a shape factor SF defined, by an equation of the fine particles of chitosan in a cross section of acrylic fibers, is from 100 to 300 and its standard deviation is not more than 150, said equation being $SF=ML^2\times\pi\times100/(4\times A)$ wherein ML represents a maximum length of fine particles of chitosan in a cross section of fibers, and A represents an area of fine particles of chitosan in a cross section of fibers, the chitosan-containing acrylic fibers further having a quaternary ammonium salt content of more than the total chitosan content to not more than 3% by weight.

2. Chitosan-containing acrylic fibers according to claim 1, wherein X is an anion selected from the group consisting of carboxylate ion, sulfonate ion, sulfate ion, phosphate ion and phosphonate ion.

3. Chitosan-containing acrylic fibers according to claim 1, wherein the quaternary ammonium salt is represented by the general formula (I)

$$[R_1R_2R_3R_4N]^+_aX^{a-}$$

wherein $R_1$ to $R_4$ independently represent an optionally substituted alkyl group having 1 to 18 carbon atoms; X represents a halogen ion, an organic and anion or an oxo-acid ion; and a represents the valence of X.

4. Chitosan-containing acrylic fibers according to claim 3, wherein X is a carboxylate ion.

5. Chitosan-containing acrylic fibers according to claim 3, wherein X is a sulfonate ion.

6. Chitosan-containing acrylic fibers according to claim 3, wherein X is a sulfate ion.

7. Chitosan-containing acrylic fibers according to claim 3; wherein X is a phosphate ion.

8. Chitosan-containing acrylic fibers according to claim 3, wherein X is a phosphonate ion.

9. Chitosan-containing acrylic fibers according to claim 3, wherein $R_1$ to $R_4$ are independently selected from the group consisting of a $C_1$–$C_{18}$ alkyl group, a hydroxyl-substituted $C_1$–$C_8$ alkyl group, and a $C_1$–$C_{20}$ alkylcarbonyl amino-substituted $C_1$–$C_8$ alkyl group.

10. Chitosan-containing acrylic fibers having a total chitosan content of 0.05 to 2% by weight and an extractable chitosan content of not less than 0.03% by weight to less than the total chitosan content.

11. Chitosan-containing acrylic fibers according to claim 10, wherein a difference between the total chitosan content and extractable chitosan content is from 0.03 to 0.8% by weight.

12. Chitosan-containing acrylic fibers having a total chitosan content of 0.05 to 2% by weight, wherein chitosan is dispersed in the fibers in the form of fine particles and an equivalent-circle average diameter of the fine particles in a cross section is from 1 to 100 nm.

13. Chitosan-containing acrylic fibers according to claim 10, wherein an average of a shape factor SF defined by the following equation of the fine particles of chitosan is from 100 to 300 and its standard deviation is not more than 150:

$$SF=ML^2\times\pi\times100(4\times A)$$

wherein ML represents a maximum length of fine particles of chitosan in a cross section of fibers, and A represents an area of fine particles of chitosan in a cross section of fibers.

14. Chitosan-containing acrylic fibers having a total chitosan content of 0.05 to 2% by weight and a quaternary ammonium salt content of more than the total chitosan content to not more than 3% by weight.

15. Chitosan-containing acrylic fibers according to claim 14, wherein the quaternary ammonium salt is represented by the general formula (I):

$$[R_1R_2R_3R_4N]+_aX^{a-} \quad (I)$$

wherein $R_1$ to $R_4$ independently represent an optionally substituted alkyl group having 1 to 18 carbon atoms; X represents a halogen ion, an organic acid anion or an oxo-acid ion; and "a" represents a valence of X.

16. Chitosan-containing acrylic fibers according to claim 15, wherein X is an anion selected from the group consisting of carboxylate ion, sulfonate ion, sulfate ion, phosphate ion and phosphonate ion.

17. Chitosan-containing acrylic fibers having a total chitosan content of 0.05 to 2% by weight and an extractable chitosan content of not less than 0.03% by weight, a difference between the total chitosan content and extractable chitosan content being from 0.03 to 0.8% by weight, wherein chitosan is dispersed in the fibers in the form of fine particles and an equivalent-circle average diameter of the fine particles in a cross section is from 1 to 100 nm, and wherein an average of a shape factor SF of the fine particles of chitosan in a cross section of acrylic fibers is from 100 to 300 and its standard deviation is not more than 150, said shape factor SF being defined by the equation:

$$SF: ML^2\times\pi\times100(4\times A)$$

wherein ML represents a maximum length of fine particles of chitosan in a cross section of fibers, and A represents an area of fine particles of chitosan in a cross section of fibers.

18. Chitosan-containing acrylic fibers having a total chitosan content of 0.05 to 2% by weight and an extractable chitosan content of not less than 0.03% by weight, a difference between the total chitosan content and extractable chitosan content being from 0.03 to 0.8% by weight, and a quatemary ammonium salt content of more than the total chitosan content to not more than 3% by weight.

19. Chitosan-containing acrylic fibers according to claim 17, wherein the quatemary ammonium salt is represented by the general formula (I):

$$[R_1R_2R_3N]+_a X^{a-}$$

wherein $R_1$ to $R_4$ independently represent an optionally substituted alkyl group naming 1 to 18 carbon atoms; X represents a halogen ion; an organic acid anion or an oxo-acid ion; and "a" represents a valence of X.

20. Chitosan-containing acrylic fibers according to claim 18, wherein X is an anion selected from the group consisting of carboxylate ion, sulfonate ion, sulfate ion, phosphate ion and phosphonate ion.

* * * * *

UNITED STATES PATENT AND TRADEMARK OFFICE

CERTIFICATE OF CORRECTION

PATENT NO. : 6,551,705 B1
DATED : April 22, 2003
INVENTOR(S) : Hiroaki Ohnishi et al.

It is certified that error appears in the above-identified patent and that said Letters Patent is hereby corrected as shown below:

Title page,
Item [73], Assignee, "Mitsubishi Rayon Co., Ltd., Tokyo (JP)" should read
-- Mitsubishi Rayon Co., Ltd., Tokyo (JP); Solutia Inc., St. Louis, MO (US) --.

Signed and Sealed this

Fourth Day of November, 2003

JAMES E. ROGAN
*Director of the United States Patent and Trademark Office*